United States Patent [19]

Gugel et al.

[11] Patent Number: 5,033,885

[45] Date of Patent: Jul. 23, 1991

[54] DOT MATRIX PIN PRINT HEAD

[75] Inventors: Bernhard Gugel, Ulm-Einsingen; Johann Stempfle, Pfaffenhofen, both of Fed. Rep. of Germany

[73] Assignee: Mannesmann Aktiengesellschaft, Düsseldorf, Fed. Rep. of Germany

[21] Appl. No.: 342,454

[22] Filed: Apr. 21, 1989

[30] Foreign Application Priority Data

Apr. 22, 1988 [EP] European Pat. Off. ..... 88730095

[51] Int. Cl.[5] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,393,771 | 7/1983 | Tatsumi | 400/124 |
| 4,575,268 | 3/1986 | Yang et al. | 400/124 |
| 4,674,897 | 6/1987 | West et al. | 400/124 |
| 4,840,501 | 6/1989 | Wong et al. | 400/124 |

FOREIGN PATENT DOCUMENTS

| | | | |
|---|---|---|---|
| 124259 | 7/1985 | Japan | 101/93.05 |
| 127166 | 7/1985 | Japan | 400/124 |
| 168661 | 9/1985 | Japan | 400/124 |
| 002569 | 1/1986 | Japan | 400/124 |

*Primary Examiner*—Edgar S. Burr
*Assistant Examiner*—Ren Yan
*Attorney, Agent, or Firm*—Cohen, Pontani & Lieberman

[57] ABSTRACT

A dot matrix pin print head is formed of a rear electromagnet drive assembly (1) and a front pin-guide assembly (2) located opposite a print support (3), the electromagnet drive assembly (1) consisting of a plurality of identical electromagnet/flap-armature systems corresponding to the number of print pins (9) and each of the electromagnet/flap-armature systems having a U-shaped magnet yoke (10) with an oppositely-disposed, pivotably mounted flap armature (12). With this arrangement, the mass of the flap armature (12) is reduced, its operative guidance is improved and the magnetic flux is optimized by further providing the flap armature (12) with at least one projection (21) which extends transverse to the longitudinal extension of the armature and which is received in a recess (22), and by pivotably supporting the flap armature (12) at a location substantially opposite the projection (21).

10 Claims, 2 Drawing Sheets

DOT MATRIX PIN PRINT HEAD

FIELD OF THE INVENTION

The present invention relates to a dot matrix pin print head which includes a rear electromagnetic drive assembly and a forward pin-guide assembly disposed opposite a print support, the electromagnetic drive assembly consisting of a multiplicity of identical electromagnet/flap-armature systems corresponding to the number of print pins and each of the systems having a U-shaped magnet yoke with a pivotally mounted flap armature.

BACKGROUND OF THE INVENTION

The electromagnet/flap-armature system of such dot matrix pin print heads is of relatively complex construction which often provides insufficient operative guidance of the armature, requires costly and bulky configuration of the armature and is characterized by low magnetic fluxes with substantial stray flux.

It is known (as for example disclosed in European Patent No. 0 152 117) to develop a laminated armature as a flap armature and to provide it with a spring pivot. Such spring pivots, however, are expensive and problematic with regard to the material. Moreover, only with great difficulty can the spring pivot arrangement provide a favorable magnetic flux through the secondary air gap.

Where construction of the armature is effected without a spring pivot so as to produce an armature of solid material, it is known to facilitate guidance of the armature by way of a supporting pin and rubber ring which are both arranged on one side of the armature (as in European Patent No. 0 157 014), or to guide the armature with recesses between projections (as in European Patent No. 0 110 662); still another known guidance arrangement (as in U.S. Pat. No. 4,140,406) consists of a plug or slot mounting of the armature at the radially outer end in conjunction with radially inner lateral guidance.

All of these guidance constructions and procedures presuppose a complicated manufacturing method and are not very precise. The guidance of the magnetic flux in such constructions is furthermore unsatisfactory. In addition, higher drive forces and, correspondingly, larger electromagnet coils—i.e. with a higher number of ampere turns—are also required for such heavy armatures.

SUMMARY OF THE INVENTION

The object of the invention is, therefore, to improve the operating guidance of an armature of reduced mass and, at the same time, to optimize the magnetic flux.

This and other objects of the invention are achieved in accordance with the present invention by a dot matrix pin print head construction wherein a flap armature includes a projection arranged transverse to the armature elongation and which projection engages a recess defined in the print head, preferably in the electromagnet yoke, the flap armature being supported for pivotal movement substantially opposite the projection. In the case of laminated armatures, for example, from a manufacturing standpoint such a projection may be readily formed. This projection (or, optionally, several projections) guides the operating armature in a simple and precise manner; it also advantageously provides more favorable guidance of the magnetic flux in that the shifting of armature guidance away from the narrow sides of the armature reduces the distance to the magnet yoke. Through engagement of the projection in the recess, therefore, guidance of the armature is simplified and improved and the magnetic flux is optimized. It is, moreover, possible to effectively utilize narrower armatures than those previously employed—i.e. the previously-employed lateral guides are shifted either downward or upward above the armature.

Lateral guidance in connection with the projection is achieved without loss of space, even with a saving of space, in that the projection may be provided, in a laminated folding armature, in the substantial center of the laminated flap armature and having a thickness less than the width of the armature.

The same guidance effects and the optimizing of magnetic flux in a compact construction are further achieved by defining the recess, rather than in the magnet yoke, in a pin-guide housing located opposite the magnet yoke and containing the pin-guide assembly. Nevertheless, a particularly close association of the armature and electromagnet drive assembly, including the guide means (projection and recess), results when the recess is arranged in a leg of the magnet yoke. In this latter case, a transfer of magnetic flux without disturbance of stray fluxes and without large secondary air gaps is possible.

In accordance with further features of the invention there is provided, spaced along the flap armature elongation by the width of a wall web of the recess in the magnet yoke leg, an additional or second projection from the armature for engagement with a second recess defined in the electromagnet device assembly. This allows the flap armature to be swung or pivoted snugly and essentially free of bearing play. The additional projection also improves guidance of the armature in its longitudinal direction.

The bearing play for a swinging or pivotal movement of the armature is further minimized or entirely eliminated transverse to the longitudinal direction or elongation of the armature by the provision, in the region of the radially inner leg of the magnet yoke, opposite the yoke and adjacent the recess, of a resilient bearing ring arranged in the pin-guide housing.

For laminated armatures, the manufacture of which requires special measures for the connecting of the lamellae, the present invention further provides that the resilient bearing ring may be disposed between a radially inner annular shoulder, which extends from the radially extending wall of the pin-guide housing, and a radially outer annular shoulder, and that the radially outer annular shoulder and radially extending wall of the pin-guide housing together define a free space which receives the operative pivotal movements of the flap armature.

These and other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
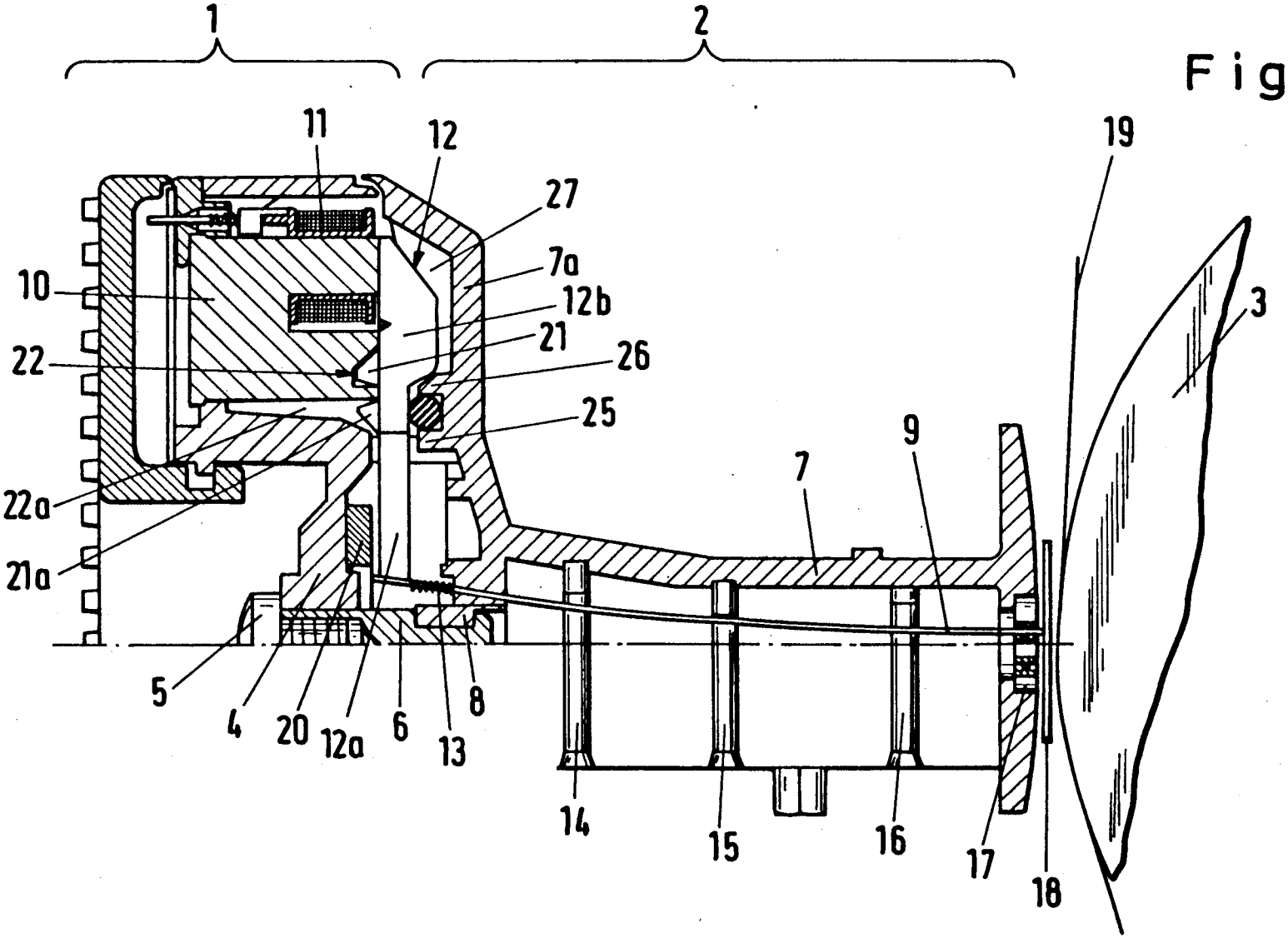
FIG. 1 is a sectional view of a dot matrix pin print head assembly constructed in accordance with the teachings of the present invention.

The dot matrix pin print head illustrated in the drawings comprises a rear electromagnet drive assembly 1 and a front pin-guide assembly 2. The front pin-guide assembly 2 is arranged opposite a print support 3 such, for example, as a platen.

The electromagnet drive assembly 1 comprises a coil carrier 4 which, through a central screw 5 and central bushing 6, is firmly secured to a pin-guide housing 7. Thus, the carrier 4 is maintained at a predetermined, fixed distance or spacing from the pin-guide housing 7 by the bushing 8.

The coil carrier 4 bears a plurality of electromagnet/-flap-armature systems corresponding to the number of print pins (as, for example, 9, 18, 24 or 48 pins). Each print pin 9 accordingly has associated with it a U-shaped magnet yoke 10, an electromagnet coil 11 and an elongated flap armature 12. The flap armature 12 is firmly connected to the print pin 9 at its radially inner arm **12*a*, and a restoring spring 13 disposed on the print pin 9 extends between and against the arm 12*a* and the pin-guide housing 7. Each of the print pins 9 is furthermore guided in transverse walls 14, 15, 16 and in mouthpiece 17**.

The flap armature 12 is shown in FIG. 1 in the printing position, in which the longitudinally-displaced print pins 9 print dots via a ink ribbon 18 on a recording medium 19. This action requires a maximum stroke path of the print pins 9 of approximately 0.5 mm. In the retracted position of each pin 9, driven by the restoring spring 13, the pivotally movable flap armature 12 strikes with its radially inner arm **12*a* against a damping ring 20**.

The precise guidance of the flap armature 12 in accordance with the invention is attained by providing a projection 21 on the armature and extending transverse to its elongation or longitudinal extension. The projection is received or engages loosely in a recess 22 which is defined, in the herein disclosed embodiment, in the magnet yoke 10. A second or additional transverse armature projection **21*a* spaced longitudinally along the armature from the first projection 21 forms a further guide for the flap armature 12 and is received in a second recess 22*a* created by suitable shaping and dimensioning of the magnet yoke 10. In a laminated flap armature 12, the projection 21 may be advantageously stamped out as a portion of a shaped sheet metal part of the armature so that, after connecting of the lamellae, the projection 21 is located centrally with respect to the width of the armature 12** and is itself narrower than the armature width.

The recess 22 is correspondingly adapted in its width with respect to the projection 21 received therein. With a sheet metal thickness of about 0.5 mm, for example, the width of the recess 22 may be selected so as to be greater than the sheet metal width by only that small amount suitable to provide appropriate minimal free play therebetween.

The recess 22 may, alternatively, be located in the pin-guide housing as, for example, in its radially extending wall **7*a***.

Figure 2:
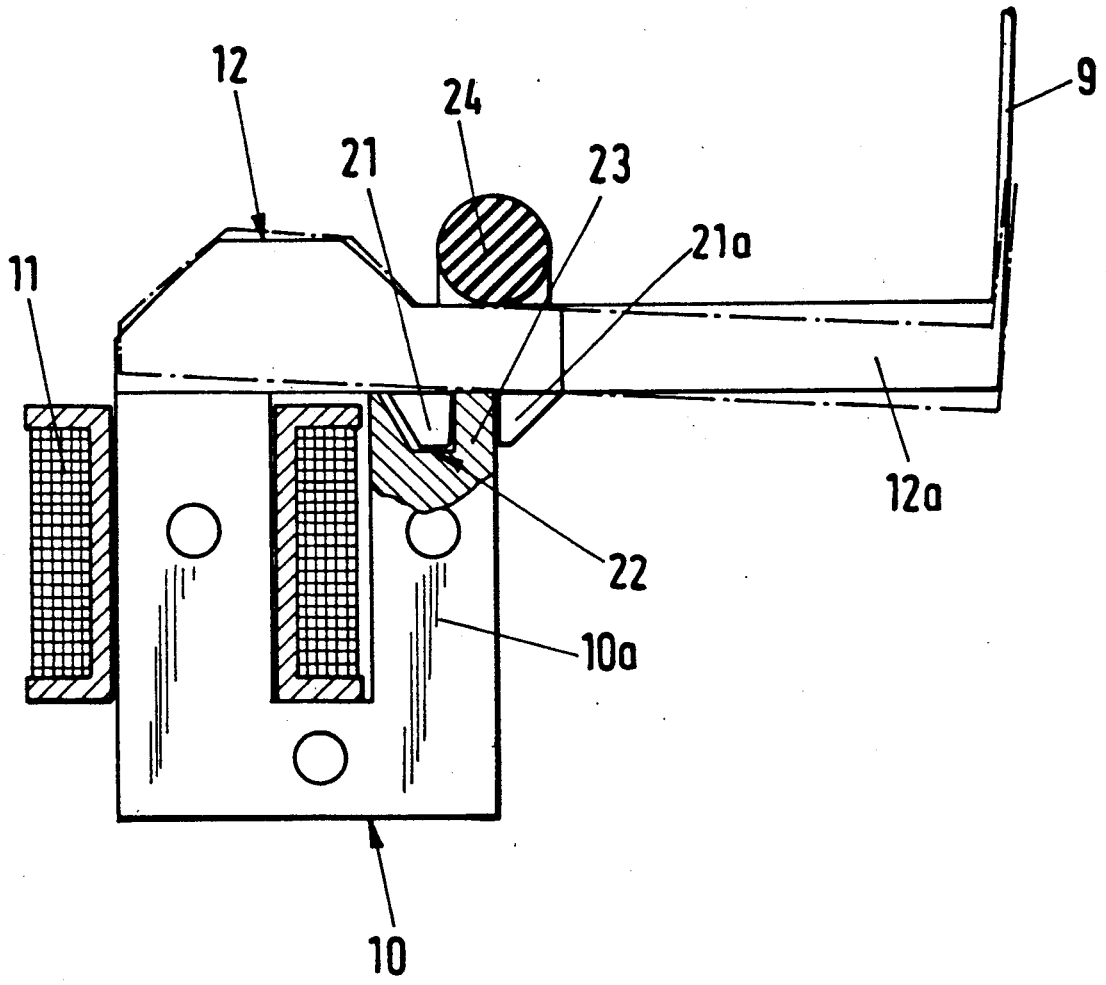
FIG. 2 is an enlarged sectional detail of the electromagnet/flap-armature system of FIG. 1 illustrating guidance of the pivoting armature in accordance with the invention.

With particularly reference now to FIG. 2, the illustrated embodiment of the invention has the recess 22 defined in a leg **10*a* of the magnet yoke 10. By this arrangement there remains in the magnet yoke leg 10*a* a wall web 23. The flap armature 12 pivotably swings or moves, with the inclusion of the second projection 21*a*, snugly and substantially free of play about or around the swing or pivot bearing formed by the wall web 23. Thus, the width or thickness of wall web 23 defines the spacing between the armature projections 21, 21*a*. The flap armature 12 is further movably guided by a resilient bearing ring 24 located approximately opposite the wall web 23. The resilient bearing ring 24—herein disclosed and illustrated, by way of example, in the form of an O-ring—is held in the region of the radially inner leg 10*a* of the magnet yoke (FIG. 1) and against the radially extending wall 7*a* of the pin-guide housing 7 by and between a radially inner annular shoulder 25 and a radially outer annular shoulder 26. The radially extending wall 7*a* defines, adjacent the radially inner and outer annular shoulders 25, 26, a free space 27 (FIG. 1) in which the radially outer arm 12*b* of the flap armature 12—which arm 12*b* is wider than the inner arm 12*a*—is movable as the flap armature operatively pivots between the solid and broken line positions shown in FIG. 2. This path of pivotal movement, however, is very short for the generally contemplated print pin stroke of about 0.5 mm, so that a sufficiently dimensioned free space 27** can be provided even with a compact construction of the dot matrix pin print head of the invention.

While there have been shown and described and pointed out fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A dot matrix pin print head for a printer apparatus having a print support (3), comprising:

a recess (22) defined in said print head;

a front print pin-guide assembly (2) disposed opposite the print support (3); and a rear electromagnet drive assembly (1) comprising an electromagnet/flap-armature system including a substantially U-shaped magnet yoke (10) and an elongated flap armature (12) disposed for pivotal movement opposite said magnet yoke (10), said flap armature (12) having at least a first projection (21) integral with the armature and extending in a direction transverse to the armature elongation, said projection being receivable in said recess (22) of said print head and movable relative to the recess, during said pivotal movement of the armature, in a direction along the transverse extension of said projection for facilitating guided pivotal movement of the flap armature (12) during operation of the print head, and said flap armature (12) being disposed for said pivotal movement about a location approximately opposite said first projection (21) and substantially midway between its ends.

2. A dot matrix pin print head in accordance with claim 1 wherein the print head includes a plurality of print pins, said rear electromagnet drive assembly (1) comprising a plurality of said electromagnet/flap-armature systems corresponding in number to said plurality of print pins (9).

3. A dot matrix pin print head in accordance with claim 1, wherein said flap armature (12) has a width, and said first projection (21) is defined substantially centrally of said width and has a width narrower than said armature width.

4. A dot matrix pin print head in accordance with claim 3, wherein said flap armature (12) comprises a laminated flap armature.

5. A dot matrix pin print head in accordance with claim 1, wherein said recess (22) is defined in said magnet yoke (10).

6. A dot matrix pin print head in accordance with claim 1, wherein said recess (22) is defined in a leg (10*a*) of said magnet yoke (10).

7. A dot matrix pin print head in accordance with claim 1, wherein said recess (22) is defined in said magnet yoke (10) and said yoke (10) includes a wall web (23) which at least partly defines said recess (22) and which has a width, further comprising a second projection (21*a*) extending outwardly from said armature (12) and spaced from said first projection (21) by an amount substantially corresponding to said wall web width such that said wall web (23) is received between said first and second projections (21, 21*a*) so as to enable pivotal movement of said flap armature (12) at said wall web and substantially free of bearing play.

8. A dot matrix pin print head in accordance with claim 1 wherein said front pin-guide assembly includes a pin-guide housing (7), further comprising a resilient bearing ring (24) arranged in the pin-guide housing (7) proximate a radially inner leg (10*a*) of said magnet yoke (10) and substantially opposite said recess (22).

9. A dot matrix pin print head in accordance with claim 8 wherein said pin-guide housing (7) includes a radially inner annular shoulder (25), a radially outer annular shoulder (26) and a radially extending wall (7*a*), said resilient bearing ring being disposed between said radially inner and radially outer annual shoulders (25, 26), and said radially outer annual shoulder (26) and radially extending wall (7*a*) defining a free space (27) for receiving at least a portion of said flap armature (12) during pivotal movement of said armature.

10. A dot matrix pin print head for a printer apparatus having a print support (3), comprising:

a recess (22) defined in said print head;

a front print pin-guide assembly (2) disposed opposite the print support (3); and a rear electromagnet drive assembly (1) comprising an electromagnet/flap-armature system including a substantially U-shaped magnet yoke (10) and an elongated flap armature (12) disposed for pivotal movement opposite said magnet yoke (10), said flap armature (12) having at least a first projection (21) extending in a direction transverse to the armature elongation and receivable in said recess (22) of said print head for facilitating guided pivotal movement of the flap armature (12) during operation of the print head, and said flap armature (12) being disposed for said pivotal movement about a location approximately opposite said first projection (21);

wherein said recess (22) is defined in said magnet yoke (10) and said yoke (10) includes a wall web (23) which at least partly defines said recess (22) and which has a width, further comprising a second projection (21*a*) extending outwardly from said armature (12) and spaced from said first projection (21) by an amount substantially corresponding to said wall web width such that said wall web (23) is received between said first and second projections (21, 21*a*) so as to enable pivotal movement of said flap armature (12) at said wall web and substantially free of bearing play.

* * * * *